US007230597B2

(12) United States Patent
Edwards et al.

(10) Patent No.: US 7,230,597 B2
(45) Date of Patent: Jun. 12, 2007

(54) ACTIVE MATRIX ARRAY DEVICES

(75) Inventors: Martin J. Edwards, Crawley (GB); John R. A. Ayres, Reigate (GB)

(73) Assignee: TPO Hong Kong Holding Limited, Shatin, Hong Kong SAR (CN)

( * ) Notice: Subject to any disclaimer, the term of this patent is extended or adjusted under 35 U.S.C. 154(b) by 498 days.

(21) Appl. No.: 10/191,293

(22) Filed: Jul. 9, 2002

(65) Prior Publication Data

US 2003/0016202 A1 Jan. 23, 2003

(30) Foreign Application Priority Data

Jul. 13, 2001 (GB) ..... 0117070.3
Oct. 30, 2001 (GB) ..... 0125968.8

(51) Int. Cl.
*G09G 3/36* (2006.01)

(52) U.S. Cl. ..... 345/87; 345/55; 345/90; 345/92

(58) Field of Classification Search ..... 345/87, 345/89, 90, 92, 98–100, 55
See application file for complete search history.

(56) References Cited

U.S. PATENT DOCUMENTS

| | | | | |
|---|---|---|---|---|
| 4,406,997 | A | 9/1983 | Depp et al. | 340/718 |
| 4,430,648 | A | 2/1984 | Togashi et al. | 340/718 |
| 4,870,396 | A | 9/1989 | Shields | 340/719 |
| 5,130,829 | A | 7/1992 | Shannon | 359/59 |
| 5,325,442 | A | 6/1994 | Knapp | 382/4 |
| 5,349,174 | A | 9/1994 | Van Berkel et al. | 250/208.1 |
| 5,396,261 | A | 3/1995 | Hastings, III | 345/92 |
| 5,448,258 | A | 9/1995 | Edwards | 345/90 |
| 5,712,652 | A | 1/1998 | Sato et al. | 345/90 |
| 5,923,311 | A | 7/1999 | Edwards | 345/92 |
| 5,977,940 | A | 11/1999 | Akiyama et al. | 345/94 |
| 2002/0075211 | A1* | 6/2002 | Nakamura | 345/87 |

FOREIGN PATENT DOCUMENTS

| | | |
|---|---|---|
| WO | WO0101384 | 4/2001 |

* cited by examiner

*Primary Examiner*—Jimmy H. Nguyen
(74) *Attorney, Agent, or Firm*—Liu & Liu

(57) ABSTRACT

An active matrix device includes a plurality of display elements 10 including a data storage node 18, 72 for storing data in the form of charge on a capacitor 72 and/or capacitative element 18. Refresh circuitry 51 is provided to refresh the data storage node, for example including temporary storage circuit 55 and drive circuit 56.

20 Claims, 12 Drawing Sheets

ACTIVE MATRIX ARRAY DEVICES

The present invention relates to active matrix array devices comprising arrays of matrix elements, and particularly, although not exclusively, to active matrix devices in which the matrix elements comprise display pixels, especially active matrix liquid crystal display devices and active matrix electroluminescent display devices.

Active matrix display devices, and more notably active matrix liquid crystal display devices (AMLCDs) are now used in an increasing variety of product areas, amongst which laptop and notebook computer screens, desk top computer monitors, PDAs, electronic organisers and mobile phones are perhaps the most familiar.

Examples of active matrix devices other than display devices include sensing devices such as image sensing devices and fingerprint sensing devices in which the matrix elements comprise for example optical or capacitance sensing elements, transducer devices, in which the matrix elements comprise moveable electromechanical elements, for example piezoelectric or electrostatically controlled actuator elements.

The structure and general operation of a typical active matrix display device, in this case an AMLCD, are described in, for example, U.S. Pat. No. 5,130,829 whose whole contents are incorporated herein by way of reference material. Briefly, such a display device comprises an array of pixels, arranged in rows and columns, each comprising an electro-optic display element and an associated switching device, usually in the form of thin film transistor (TFT). The pixels are connected to sets of row and column address electrodes, each pixel being located adjacent the intersection between a respective electrode of each set, via which the pixels are addressed with selection (scanning) signals being applied to each of the row electrodes in sequence to select that row and with data (video information) signals being supplied in synchronism with row selection via the column address electrodes to the pixels of the selected row and determining the display outputs of the individual pixels of the row concerned. The data signals are derived by appropriately sampling an input video signal in a column address circuit coupled to the column address electrodes. Each row of pixels is addressed in turn so as to build up a display from the whole array in one field (frame) period, with the array of pixels being repeatedly addressed in this manner in successive fields. There is a need to refresh the pixels regularly with video information due to losses which occur in the pixels. In the case of an AMLCD, the polarity of the data signal voltage applied to the display elements needs to be inverted periodically in order to prevent degradation of the LC material. This may be done for example after each field (so-called field inversion) or after each row has been addressed as well (so-called line inversion).

A significant fraction of the power consumption of an active matrix display device is associated with transferring video information from the video signal source to the pixels of the display device. This component of the power can be reduced if the pixels of the display device are able to store the video information for an indefinite period of time. In this case the addressing of the pixels with fresh video information can be suspended when no change to the display output (brightness) state of pixels is required.

Displays in which video information is stored within the pixels of the display device have been proposed previously. For example it is indicated in U.S. Pat. No. 4,430,648, whose whole contents are incorporated herein by way of reference material, that an active matrix LC display can in principle be operated in a manner similar to a dynamic memory with the voltages on the pixels being refreshed periodically in order to maintain an image on the display. This is achieved by incorporating sense and refresh circuitry within the column addressing circuit of the display. During the refresh operation charge is transferred from the pixels in one row of the display device onto the corresponding, associated, column electrodes. Then the sense circuitry is used to detect this charge and determine the state of the pixels. This information is then written back to the same pixels by the refresh circuitry. One disadvantage of this approach is that because of the relatively large value of the column capacitance in comparison to the pixel capacitance the signals which must be detected by the sense circuits are relatively small. This makes the design of the sense circuits difficult and their performance critical to the operation of the display device. In particular the display device may be sensitive to sources of electrical noise. In addition, as the pixels within the display device are refreshed the columns of the display device are driven in accordance with the stored video information by the refresh circuits. The charging and discharging of the column capacitance will contribute to the power consumption of the display device.

The present invention provides active matrix array devices, and particularly active matrix display devices, that offer improvements in this respect.

In accordance with the present invention there is provided an active matrix device in which data or information is stored dynamically, in the form of charges held on capacitances within the matrix elements, having one or more novel features or combinations of features as described herein.

In accordance with a first aspect of the invention, an active matrix device comprises an array of matrix elements wherein the matrix elements each have at least one storage node having a capacitance for storing data dynamically in the form of charge stored on the capacitance and the matrix elements further include refresh circuitry for refreshing the data stored on the storage node.

Thus an active matrix device is provided in which the matrix elements (pixels) include means for refreshing the stored video information. Through this means the display output (brightness) of the pixels in a display device can be maintained even when they are not being addressed with fresh video information. An advantage of this arrangement is that, compared with the kind of device described in aforementioned U.S. Pat. No. 4,430,648, a reduction in power consumption can be obtained as it is not necessary to address the pixels when their output state is not required to change. In particular, losses occurring in any circuitry driving the column electrodes and as a result of the capacitance of the column electrodes can be avoided.

In embodiments, the refresh circuitry may include a temporary storage circuit for storing the data on the storage node and a storage node drive circuit for driving the storage node in accordance with the data stored on the temporary storage circuit. The storage node drive circuit may include an inverter for driving the storage node with the inverse of the data stored on the temporary storage circuit. In this way, inversion of the data stored on the storage node can be obtained as the storage node is being refreshed. Such inversion is particularly important in liquid crystal display devices to reduce long-term degradation of the liquid crystal.

The refresh circuitry may be driven by a refresh line for activating the refresh circuitry to refresh the storage node. In a display device embodiment, then by externally controlling the refresh the display device may be operated in a first mode in which the display device is driven dynamically without internal refresh and a second mode in which the display device displays a static image stored on the internal storage nodes which are refreshed by the internal refresh circuitry periodically in response to a periodic refresh signal on the refresh line.

The storage node may comprise a separate capacitor. Alternatively or additionally data may be stored on elements of the pixel circuitry. For example, in the case of liquid crystal displays data may be stored on the capacitance of pixel electrodes used to drive the pixels.

In embodiments each matrix element includes an address switch controlled by an address line and connected between a column line and the data storage node, a storage switch connecting the storage node to the temporary storage circuit and a refresh switch connecting the storage node to the storage node drive circuit, the storage switch and the refresh switch having control terminals connected to a common refresh line for switching between a first setting in which the storage switch is open and the refresh switch is closed and a second setting in which the storage switch is closed and the refresh switch is open in the first setting the storage node can be refreshed, and in the second setting data on the storage node can be stored on the temporary storage circuit.

The matrix elements (pixels) may include a plurality of data storage capacitances for storing a plurality of bits of data. In this way, a static image stored on the data storage capacitors may have a number of grey levels or colours or both per matrix element. The capacitances may, for example, be separate capacitors or sections of a liquid crystal pixel element.

Each row of the device may be addressed by a plurality of row address lines controlling a plurality of address thin film transistors connected to respective data storage capacitances to select one or more of the data storage capacitors. Alternative arrangements may provide a plurality of column address lines for each column to address the plurality of address thin film transistors.

The plurality of address thin film transistors may be connected to a common drive line connected through a select transistor to the column line, wherein the select transistor is controlled by a select line. By connecting a single select transistor to the column line, rather than connecting the column line in parallel to all the address thin film transistors, the capacitance of the column line is not loaded by the address thin film transistors. Accordingly, the column line may be easier and/or quicker to drive. The select transistor may be one of the address thin film transistors or a separate transistor.

A refresh line may be provided to control the refresh circuit to connect the refresh circuit to the common drive line to refresh the selected data storage capacitor.

The refresh circuitry may include a pair of cross-coupled inverters.

In embodiments, each matrix element includes a plurality of register units connected in series, each register unit including a data storage node, and register units connected to subsequent register units including a drive means for driving the next register unit. At least one clock line may be provided for controlling the transmission of data along the series of register units. In this way, data may be provided on a data input at the start of the series of register units and passed down through the series until data has been written to each of the register units, thereby reducing the number of address or column lines required to address the plurality of data storage nodes. After the data has been written, the data can be periodically refreshed as required by the refresh circuitry.

The drive means may also function as the refresh circuit by connecting the output of the drive means back to the storage node. The drive means may be an inverter. This reduces the number of separate components required in each pixel.

The invention also relates to a method of operating an active matrix device having matrix elements including storage nodes, comprising storing image data as charge on the storage nodes and operating the active matrix device in a refresh mode including: displaying the stored image data, and periodically applying refresh signals to refresh circuitry within the matrix elements to cause the refresh circuitry to refresh the image data stored on the storage nodes.

The method may further include operating the active matrix device in a normal mode by regularly addressing the matrix elements with fresh video information and displaying the video information.

Further features and advantages of the present invention will become apparent from reading of the following description of preferred embodiments, given by way of example only, and with reference to the accompanying drawings, in which.

Like reference numerals are used throughout the Figures to denote the same, similar, or corresponding parts.

Figure 1:
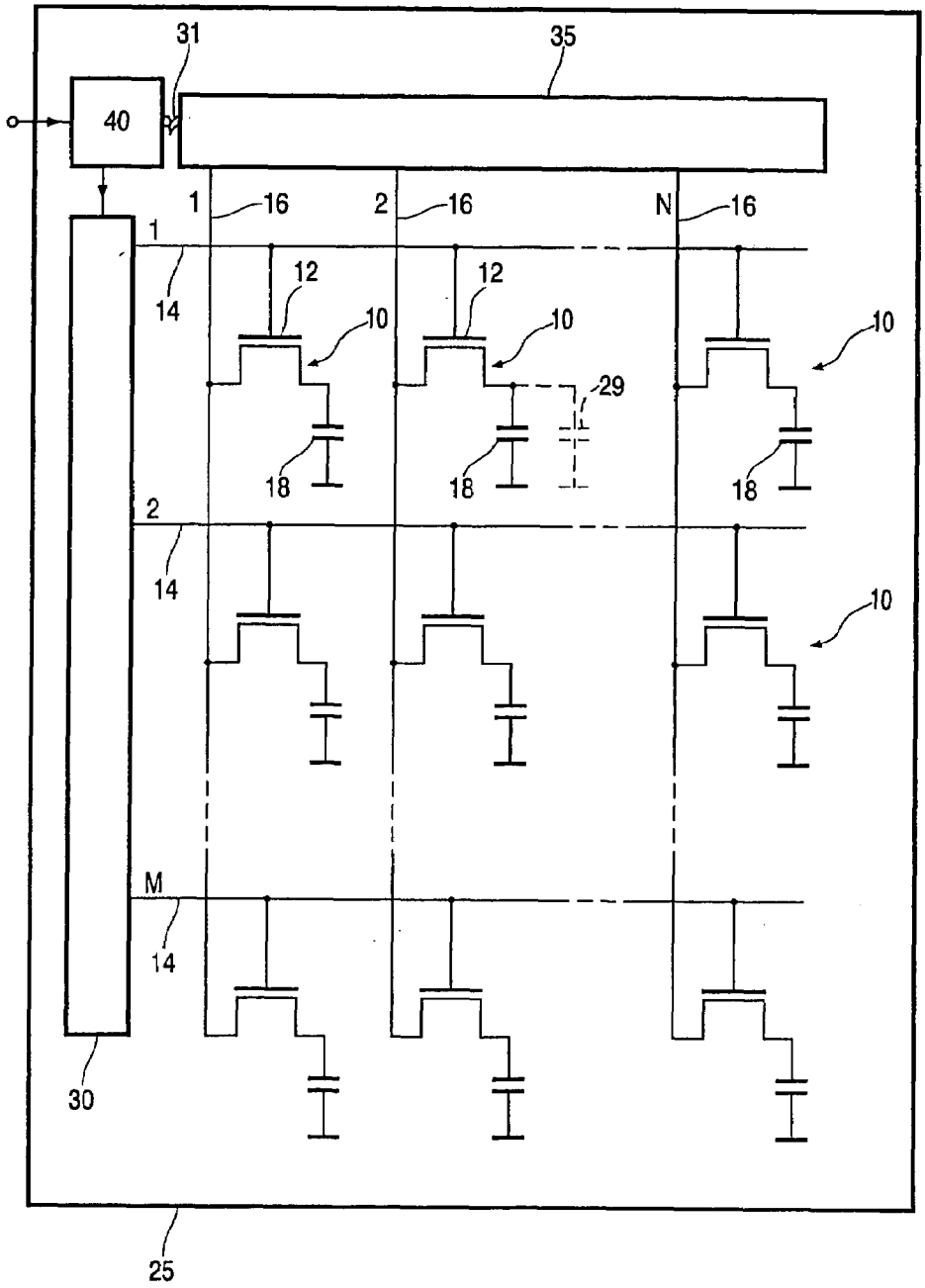
FIG. 1 is a simplified schematic diagram of a typical known AMLCD.

Referring to FIG. 1, a simplified schematic circuit diagram of a generally conventional form of AMLCD, comprising a row and column matrix array (N×M) of display pixels 10, is shown. The display pixels each have a liquid crystal display element 18 and an associated TFT 12 acting as a switching device, and are addressed via sets of (M) row and (N) column address electrodes 14 and 16. Only a few display pixels are shown here for simplicity and in practice there can be several hundred rows and columns of pixels. The drain of each TFT 12 is connected to a respective display element electrode situated adjacent the intersection of respective row and column address electrodes, while the gates of all the TFTs associated with a respective row of display pixels 10 are connected to the same row address electrode 14 and the sources of all the TFTs associated with a respective column of display pixels are connected to the same column address electrode 16. The electrodes 14, 16, the TFTs 12, and the display element electrodes are all carried on the same insulating substrate, for example of glass, and fabricated using known thin film technology involving the deposition and photolithographic patterning of various conductive, insulating and semiconductive layers. A second glass substrate, (not shown) carrying a continuous transparent electrode common to all display elements in the array is arranged spaced from the substrate 25 and the two substrates are sealed together around the periphery of the pixel array to define an enclosed space in which liquid crystal material is contained. Each display element electrode together with an overlying portion of the common electrode and the liquid crystal material therebetween defines a light-modulating LC display element.

In operation, selection (gating) signals are applied to each row address electrode 14 in turn, from row 1 to row M by a row driver circuit 30, comprising for example a digital shift register, and data signals are applied to the column electrodes 16, in synchronisation with the selection signals, by a column driver circuit 35. Upon each row electrode 14 being addressed with a selection signal, the pixel TFTs 12 connected to that row electrode are turned on causing the respective display elements to be charged according to the level of the data signal then existing on their associated column electrodes. After a row of pixels has been addressed in a respective row address period ($T_L$), corresponding, for example, to the line period of an applied video signal, their associated TFTs are turned off upon termination of the selection signal for the remainder of a field (frame) period in order to isolate electrically the display elements, thereby ensuring the applied charge is stored to maintain their display outputs until they are addressed again in a subsequent field period. Each of the rows of pixels in the array from row 1 to row M is addressed in turn in this way in respective successive row address periods $T_L$ so as to build up a display picture from the array in one field period Tf, where Tf is equal to, or slightly greater than $M \times T_L$, following which the operation is repeated for successive fields.

The timing of the operation of the row and column driver circuits 30 and 35 is controlled by a timing and control unit 40 in accordance with timing signals derived from an input video signal, obtained for example from a computer or other source. The video information in this input signal is supplied by a video signal processing circuit in the unit 40 to the column driver circuit 35 in serial form via a bus 37. This circuit comprises one or more shift register/sample and hold circuits which samples the video information signal in synchronism with row scanning to provide serial to parallel conversion appropriate to the row at a time addressing of the pixel array. Successive fields of video information according to successive fields of the input video IS signal are written into the array by repetitively addressing the pixel rows of the array in consecutive field periods.

For a transmissive mode of operation, the display element electrodes are formed of a light transparent conductive material such as ITO and the individual display elements serve to modulate light, for example directed onto one side from a backlight, so that a display image, built up by addressing all the pixel rows in the array, can be viewed from the other side. For a reflective mode of operation, the display element electrodes are formed of light reflecting conductive material and light entering the front of the device through the substrate carrying the common electrode is modulated by the LC material at each display element and reflected back through that substrate, depending on their display state, to generate a display image visible to a viewer at the front.

Following known practice, the polarity of the drive voltages applied to the display elements is periodically inverted, for example after every field, to avoid degradation of the LC material. Polarity inversion may also be carried out after every row (row inversion) so as to reduce flicker effects.

In this device, significant amounts of power are consumed in the transfer of video information from the video signal source to the display pixels. In the case of the display device being used in portable, battery-powered, equipment such as a notebook computer or mobile phone, it is of course desirable to minimise electrical power consumed by the display device in operation. Power consumed can be reduced if the pixels are able to store the video information for an indefinite period as the addressing of the pixels with fresh video information could be halted if the pixels are merely to continue displaying the same information and no change to their display outputs is required.

As mentioned, it has been proposed in U.S. Pat. No. 4,430,648 that video information is dynamically stored within the pixels but that the approach described for accomplishing this, involving the use of sense and refresh circuitry within the column driver circuit, leads to problems, particularly with issues concerning the design and performance of this circuitry and the fact that this manner of operation, in which the column capacitance is charged and discharged periodically, inevitably consumes electrical power.

These disadvantages can be overcome, at least to an extent, by providing refresh circuitry within the pixels of the display device.

Figure 2:
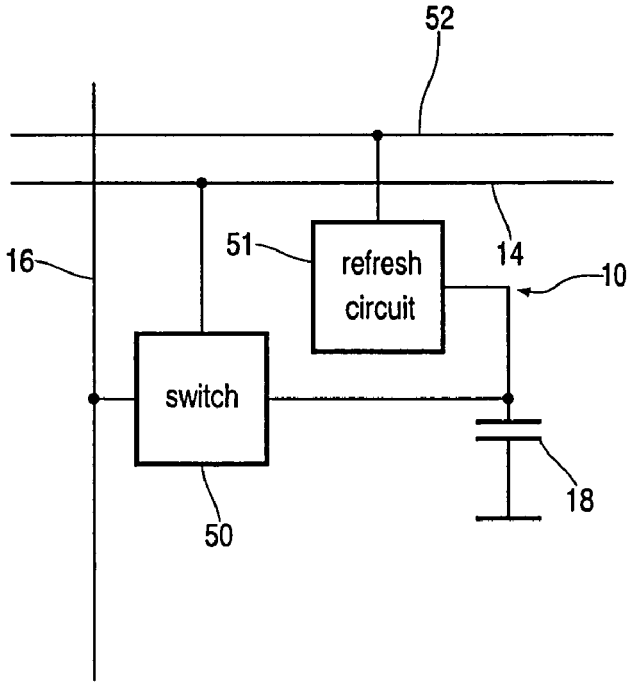
FIGS. 2 and 3 show schematically the circuits of a typical pixel in each of two embodiments of active matrix devices in accordance with the present invention.
Figure 3:
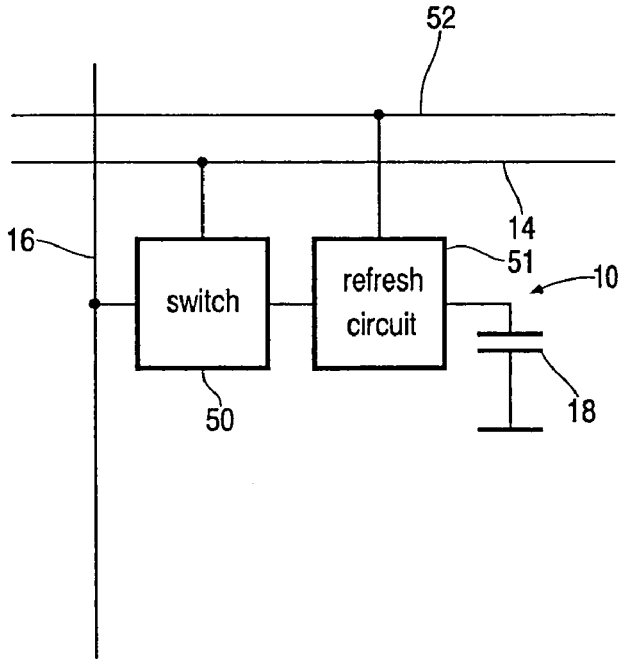

Embodiments of active matrix devices in accordance with the present invention, which utilise this approach, and comprising active matrix devices, particularly as applied to AMLCDs, will now be described with reference to FIGS. 2 and 3 which illustrate schematically typical pixel circuit arrangements in the devices.

In each case, the pixel, 10, includes two circuit elements, a switch device, 50, which is selected by the address control signal and allows video information supplied by the column drive circuit 35 of the display device to be transferred into the pixel and a refresh circuit 51 which is activated by a refresh control signal and is able to correct any degradation in the stored video information. The switching device 50 can similarly comprise a TFT 12. The LC display element, 18, is again represented as a capacitor. In each arrangement, the refresh circuit 51 is addressed via a supplementary row electrode 52 extending alongside the associated row address electrode 14.

Figure 4:
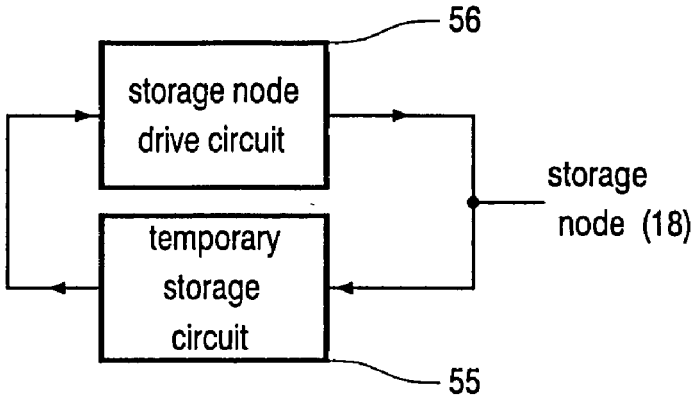
FIG. 4 illustrates schematically a functional part of the pixels of FIGS. 2 and 3.

When the pixel 10 is addressed charge which represents the video information to be displayed is placed on the display element capacitance (the combination of the liquid crystal capacitance and any pixel storage capacitance (not shown)). Over a period of time the display element capacitance will discharge and the stored video information becomes degraded. This can be prevented by periodically operating the refresh circuitry to restore the video information. The functional elements of the refresh circuit are indicated in FIG. 4. The first part of the circuit is a temporary data storage circuit 55 which holds the video information while the storage node (the display element capacitance) is being refreshed. The output of the temporary storage circuit is fed to the storage node drive circuit 56. This circuit restores the video information on the storage node to its original state.

While the function of the refresh circuit 51 is to restore the video information on the storage node, this does not necessarily mean that the voltage of the storage node, or the charge on the pixel capacitance, is restored to its initial value. It may be appropriate to modify the way in which the video information is represented. This may be done every time that the information is refreshed or at some other interval. An example of where this may be required is in the case of a liquid crystal display having the pixel architecture illustrated in FIG. 2 or 3. The stored video information also represents the drive voltage across the liquid crystal. The drive voltage applied to the liquid crystal is normally inverted periodically in order to prevent degradation of the liquid crystal material and it is therefore convenient to arrange that the storage node drive circuit 56 accommodates this requirement by inverting the voltages representing the video information each time that the pixel is refreshed.

Figure 5:
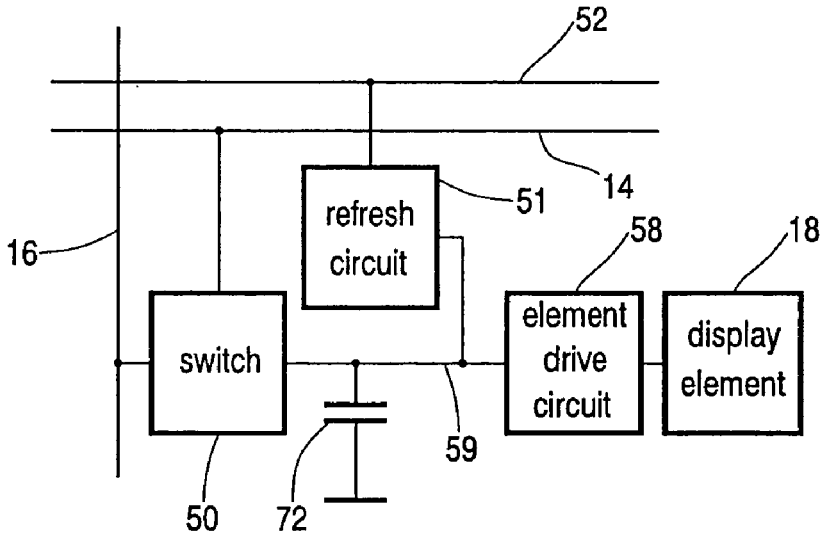
FIG. 5 shows a further possible pixel circuit arrangement having a refresh function and suitable for use also in an alternative kind of display device, such as an AMLED display device.

Another possible arrangement for a pixel circuit including a refresh function is shown in FIG. 5. In this example a separate display element drive circuit 58 is introduced between the node, 59, where the video information is stored, the data storage node, and the display element 18. As shown, a data storage capacitor 72 is associated with this node. This type of pixel architecture could be applied to a liquid crystal display but is most appropriate in situations where the display element cannot be used to store the charge representing the video information. An example of such a display would be one using light emitting diodes, for example an active matrix polymer LED or organic LED (OLED) display device. In an alternative arrangement for this pixel the input to the temporary storage circuit of the refresh circuit could be taken from the output of the element drive circuit 58. This would have the advantage of buffering the signal taken from the data storage node 59.

In the examples described so far it has been assumed that the video information is stored in the form of an amount of charge held on a capacitance within the pixel. In the simplest case the video information would represent one bit of digital data and this would determine whether the pixel output was light or dark. In principle the number of values that the video information could take can be increased by implementing refresh circuitry which is capable of detecting and restoring an increased number of voltage levels. This would allow each pixel 10 to be set to one of a number of grey levels depending on the stored video information.

Figure 6:
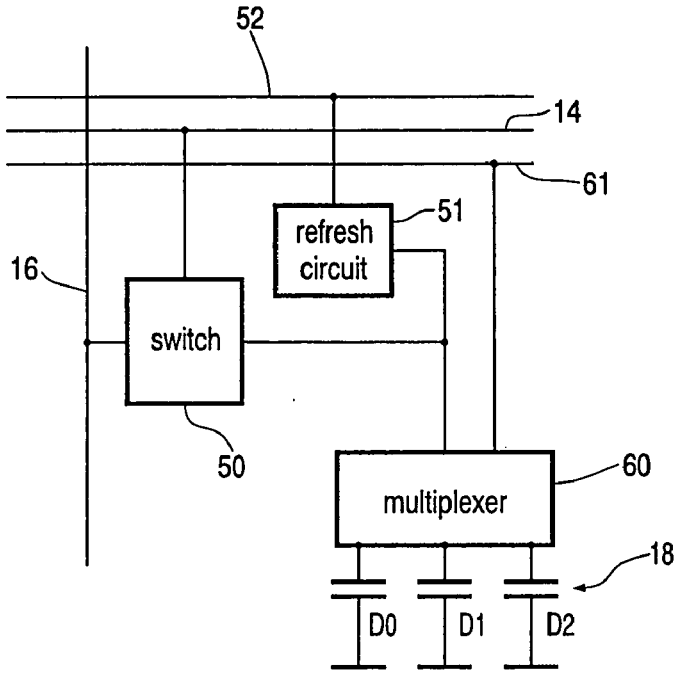
FIG. 6 shows another pixel circuit capable of storing video information as a number of binary digits.

An alternative method for achieving greyscale reproduction is to use a pixel design in which the video information is stored within the pixel in the form of a number of binary digits, as indicated in FIG. 6. This might for example be a liquid crystal display in which the display element electrode is divided into a number of binary weighted areas, represented hereby the pixel capacitances D0, D1 and D2 18. By setting the different display element regions to a dark or a light state the average brightness of the pixel could be controlled to produce a greyscale. While the sub-display elements of such a display device could use the pixel architectures indicated in the previous figures it may be desirable to use a single refresh circuit to refresh all of the sub-pixel display elements in order to reduce the complexity of the pixel circuitry. This can be achieved by using a multiplexer 60 connected between the refresh circuit 51 and the sub-display elements or data storage nodes. An example of how this could be done is illustrated in FIG. 6. In this case the multiplexer is also used during the addressing of the sub-display elements although this need not be the case. At least one supplementary row electrode 61 is used to supply video information bit control signals to the multiplexer 60; the number of supplementary row electrodes required depends on the number of sub-display elements.

The sharing of a refresh circuit 51 by the introduction of a multiplexer 60 could also be extended to an array of pixels which each contain a single storage node. For example each refresh circuit 51 could be shared between a group of three adjacent pixels in order to reduce the overall complexity of the pixel circuits. The pixels might also share a single connection to the column electrode so that with reference to FIG. 6 the three display elements 18 might be three adjacent display elements, possibly representing red, green and blue picture information, rather than three sub-elements.

Figure 7:
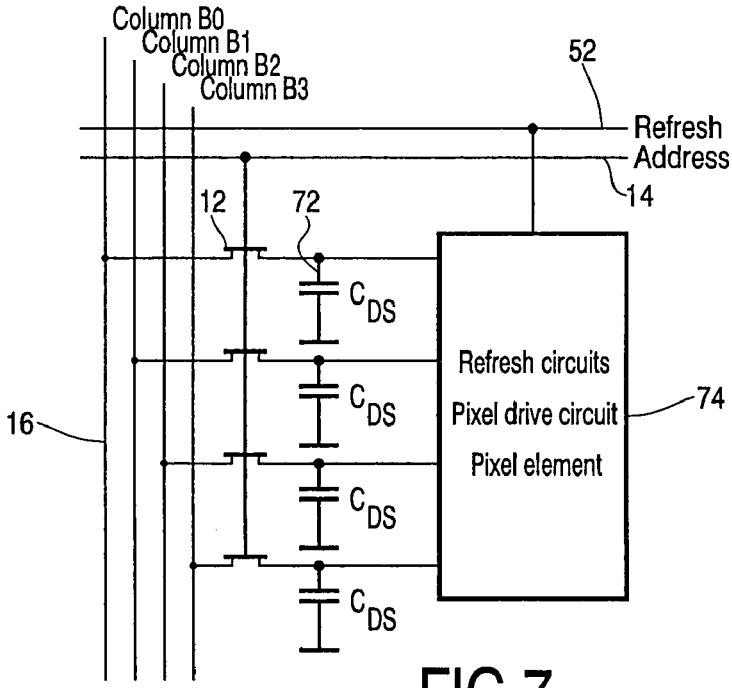
FIG. 7 illustrates a further pixel circuit with a plurality of data storage nodes.

FIG. 7 illustrates an embodiment illustrating an approach for transferring data to multiple capacitances 72 within each pixel. A plurality of column electrodes 16 are connected through respective TFTs 12 to respective capacitances 72, which may be capacitances existing within the circuit, such as the plate capacitance of the liquid crystal element or separate capacitors. Each pixel includes display circuitry 74 including refresh circuitry, drive circuitry and the pixel element. An example of the implementation of display circuitry 74 will be presented later. In use, a plurality of bits of digital data are transferred to the pixel in parallel when the address line 14 is selected.

Figure 8:
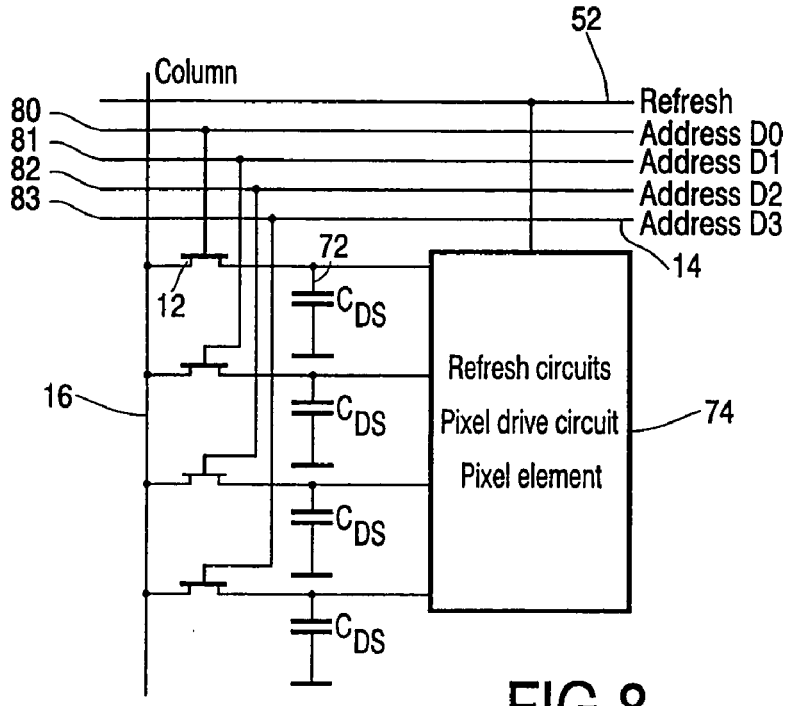
FIG. 8 illustrates another pixel circuit with a plurality of data storage nodes.

FIG. 8 illustrates an alternative drive scheme in which plural address lines 14 are provided for each row separately controlling the plurality of thin film transistors 12. In use, the address lines 14 are individually selected to deliver each successive bit to the pixel sequentially.

First 80, second 81, third 82 and fourth 83 address lines drive respective TFTs 12 which drive in turn respective first 90, second 91, third 92 and fourth 93 capacitances.

Figure 9:
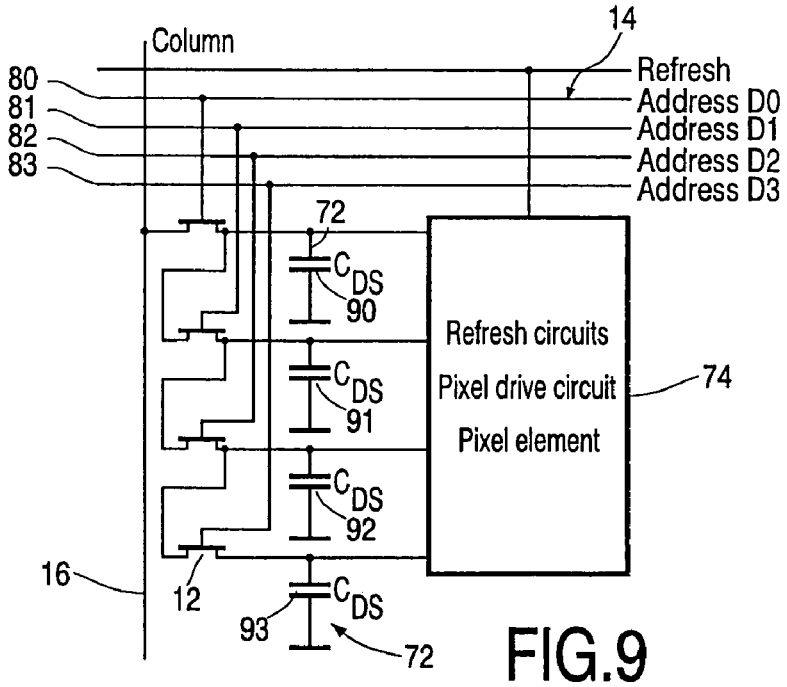
FIG. 9 illustrates a yet further pixel circuit with a plurality of data storage nodes

FIG. 9 illustrates an alternative arrangement that is a modification of the arrangement of FIG. 8. Only one of the address TFTs 12, the select transistor 78, is connected to the column line, and the rest of the TFTs are connected in series with the select transistor 78. This significantly reduces the column capacitance as compared with the example of FIG. 8. To transfer data, initially the first, second, third and fourth address lines 80, 81, 82, 83 are all selected and data is supplied along column line 16 to be written to fourth capacitance 93. Then, the fourth address line 83 is deselected and a further bit of data applied to column line 16 to be written to third capacitance 92. After deselecting the third address line 82, the second capacitance 91 can be written. Finally, the second address line 81 can be deselected, leaving only the first address line 80 selected and data is written to the first capacitance 90.

Figure 10:
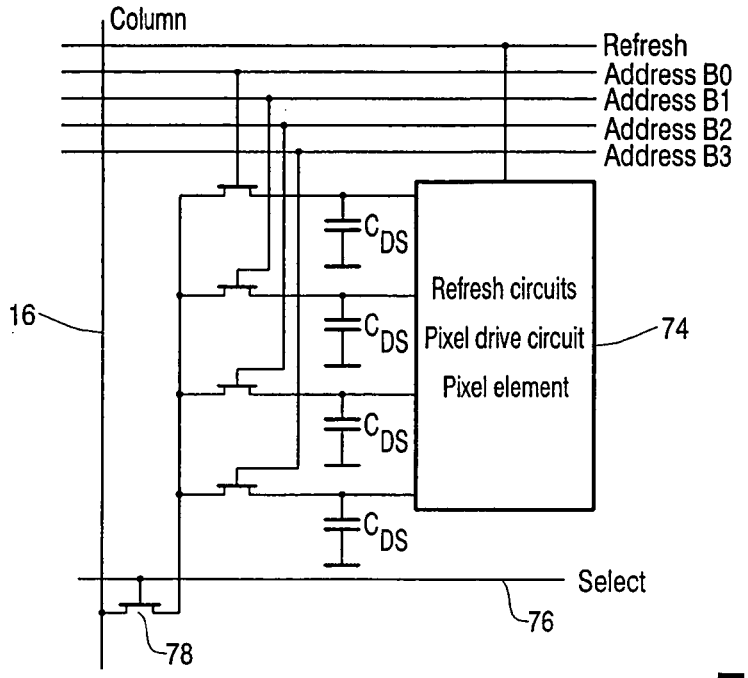
FIG. 10 illustrates yet another pixel circuit with a plurality of data storage nodes.

A disadvantage of the arrangement of FIG. 9 is that the last data storage capacitor 93 is driven through all the TFTs 12 in series. This difficulty is addressed in the embodiment shown in FIG. 10 by providing a select TFT 78 and an additional select line 76. The arrangement again ensures that only one TFT, here the select TFT 78, is connected to the column 16, whilst only two TFTs lie in the path between the capacitors and the column.

Two examples of pixel circuits for active matrix liquid crystal display devices which incorporate refreshing circuits will now be described with reference to FIGS. 11 and 12 in order to illustrate in greater detail these kinds of pixel circuits and their manner of operation. It is a feature of these circuits that they can be operated in a normal mode in which they are regularly addressed with fresh video information and have full greyscale capability and a refresh mode in which they do not need to be addressed with fresh video information but in which the number of grey levels may be limited.

Figure 11:
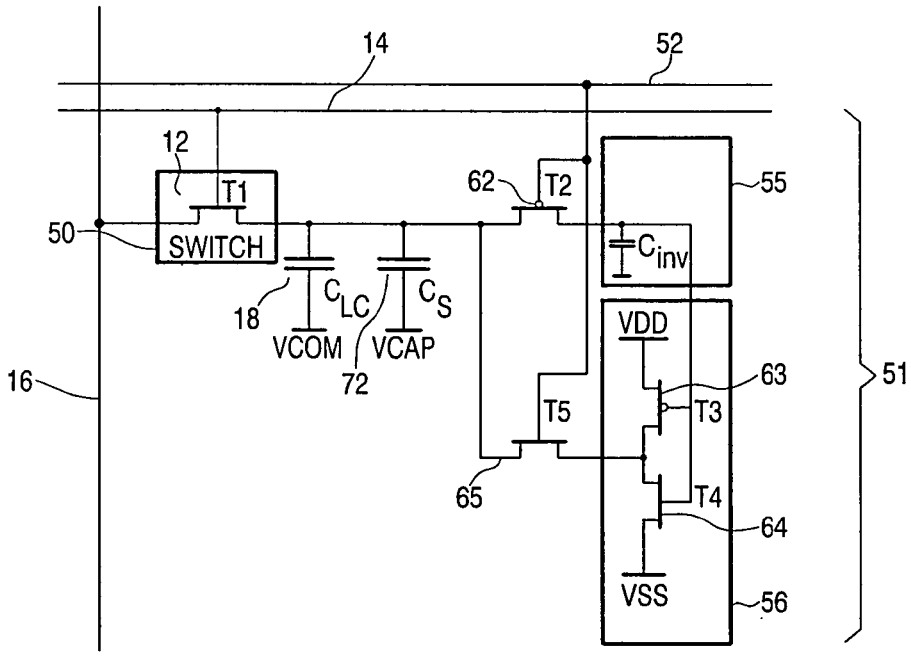
FIGS. 11 and 12 illustrate example pixel circuits according to the invention in greater detail.
Figure 12:
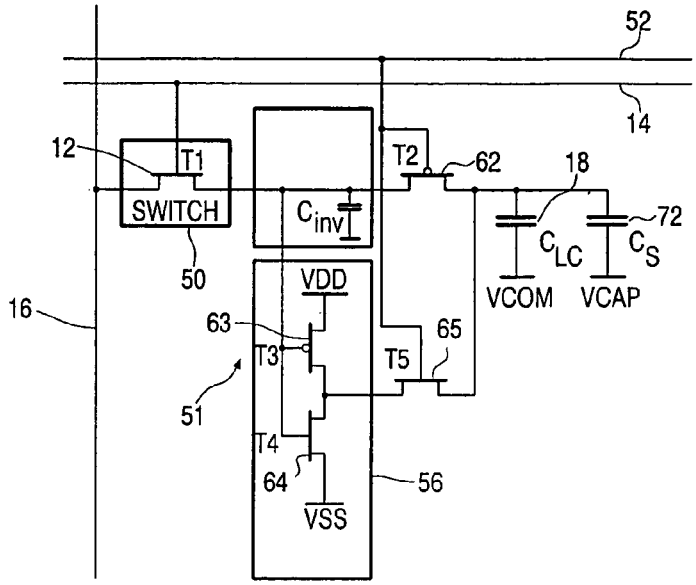

The pixel circuits shown in FIGS. 11 and 12 represent implementations of the two pixel architectures shown previously in FIGS. 2 and 3 respectively. The addressing switch 50 consists of the n-type TFT T1 12 and the pixel is addressed with video information from the column drive circuit 35 by taking the row address electrode 14 to a high voltage level. The temporary storage circuit 55 of the refresh circuit 51 consists of a p-type TFT T2 62 and a capacitor $C_{inv}$ 66. This capacitance represents the capacitance of the node of the circuit and may not be implemented necessarily as a separate physical capacitor. It may simply consist of the capacitance of the node which results from the layout of the pixel and the input capacitance of the storage node drive circuit. The gate of T2 62 is connected to the refresh electrode 52 which controls the refresh operation. The storage node drive circuit 56 consists of the CMOS inverter formed by TFT T3 63 and TFT T4 64 and the output switching transistor T5 65 which is also connected to the refresh control signal line 52. $C_{LC}$ represents the capacitance of the LC display element 18 and $C_S$ represents the storage capacitance of capacitor 72 connected to the display element electrode.

In simple terms, the refresh operation is carried out as follows. The refresh control signal is normally at a low level. To start the refresh operation the refresh signal is taken to a high voltage level. This turns off the transistor T2 62 isolating the pixel capacitors 18, 72, $C_{LC}$ and $C_S$, from the node capacitance $C_{inv}$ 66. The data voltage present on the pixel capacitors at the start of the refresh process is now held on $C_{inv}$ 66 for the duration of the refresh cycle. The inverter circuit generates a voltage at its output which represents the inverse of the logic state at its input. When the refresh signal goes high this turns on the output transistor T5 65 and therefore the pixel capacitors are charged to a voltage which represents the inverse of the signal present at the start of the refresh operation. The ability of the inverter to restore the voltage level representing the video data means that any degradation of the stored voltage level which was present at the start of the refresh period is eliminated.

Figure 13:
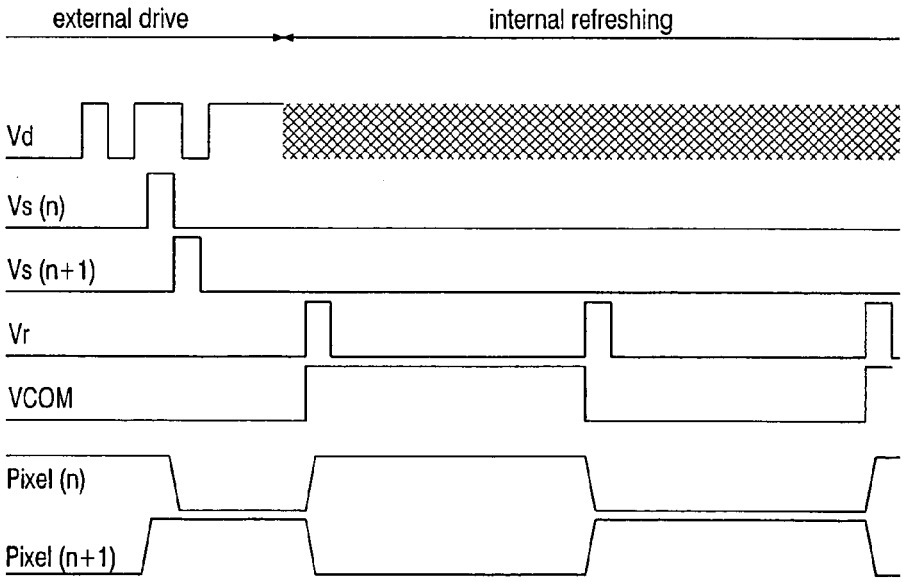
FIG. 13 illustrates typical voltage waveforms present in operation of the pixel circuits of FIGS. 11 and 12.

The operation of the pixels is further illustrated by the voltage waveforms shown in FIG. 13. This shows the drive waveforms and the pixel voltage waveforms associated with two vertically adjacent pixels, pixel (n) and pixel (n+1), within one column of the display device and in rows n and n+1. It is assumed that the display device is initially addressed with a field inversion drive scheme in which during one field period all of the pixels in the display are addressed with the same polarity of drive voltage. In addition it is assumed that part of the drive voltage required by the liquid crystal is applied to the common electrode of the display device (common electrode drive scheme). Vd is the video information (data) voltage signal waveform applied to the column electrode 16. Vs (n) and Vs(n+1) are the row drive voltage waveforms applied to the nth and (n+1)th row electrodes 14 respectively. $V_R$ is the refresh signal waveform applied to the refresh electrode 52.

The figure shows the transition of the display device from a state in which it is being addressed with external video drive signals generated by the column drive circuit 35 to a state in which the pixels 10 are being refreshed internally in order to maintain the video information already present within the pixels. During the period when the pixels are being driven externally the column electrode 16 voltage is switched according to the changing video information. Once the display device enters the internal refresh mode the column electrodes 16 no longer need to be switched and can be connected to a convenient potential, for example ground. Shortly after the end of the field in which the pixels 10 are externally addressed it is necessary to refresh the pixels for the first time and this is achieved by taking the voltage, $V_R$, on the refresh control electrode 52 to a high voltage level. In this example it is possible to connect all of the refresh electrodes 52 of the display device to the same signal although in other cases it may be necessary to provide more than one signal. The drive voltage applied to the common electrode of the display device ($V_{COM}$) must be switched while the LC pixel capacitance 18 is being charged in order for the common electrode drive scheme to operate correctly. This switching must therefore occur during the refresh period. It is important that the common electrode potential is not switched before the refresh occurs since this will change the voltage present at the input of the refresh circuit and it would no longer be possible for the refresh circuit to detect the state of the video information.

In the pixel circuits shown in FIGS. 11 and 12 it is possible to operate the pixel 10 in a full grey-scale mode by applying appropriate analogue voltages generated by the column drive circuit 35. These voltages would also be present at the input to the inverter circuit formed by T4 64 and T3 63. When intermediate voltage levels are applied to the input of a CMOS inverter significant current can be drawn from the power supply of the circuit. It would therefore be desirable to avoid this since it would result in a significant increase in the power consumption of the display device. One technique for avoiding this would be to make the voltages applied to VDD and VSS the same when the display device is operating in its normal greyscale mode. Alternatively one or more TFTs could be connected in series with the power supply lines of the inverter, these TFTs being turned off when intermediate voltages are being supplied to the pixels by the column driver circuit 35.

Figure 14:
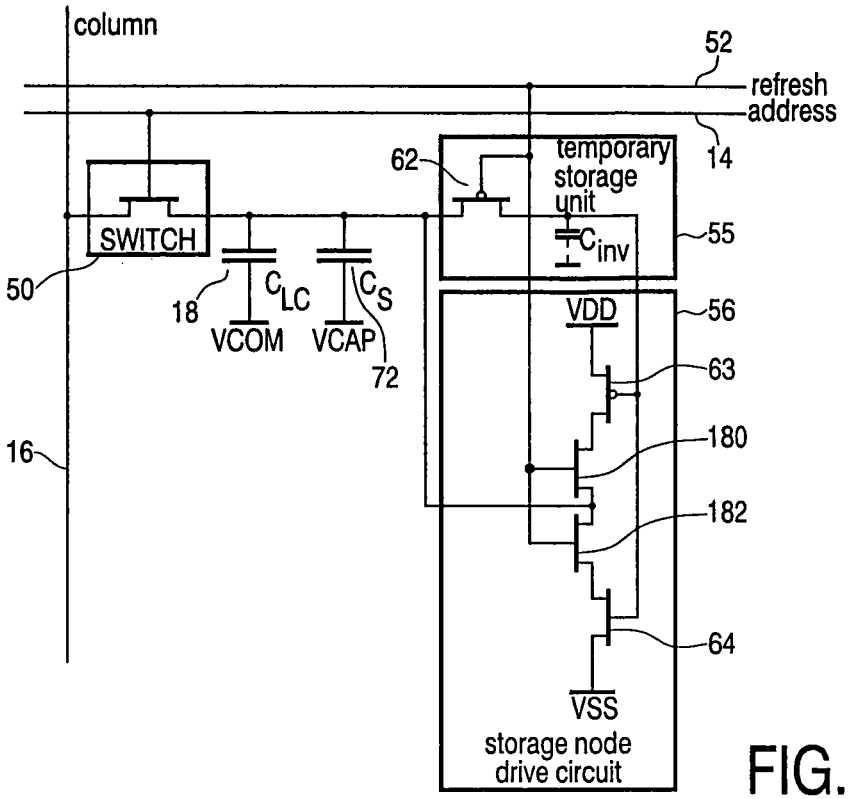
FIG. 14 illustrates an alternative pixel circuit according to the invention.

FIG. 14 illustrates a circuit for avoiding the problem of increased power consumption in the inverter circuit due to intermediate input voltage levels when operating the circuit in non-refresh grey-scale mode. Two n-type TFTs 180,182 are controlled directly by refresh line 52 and are connected in series with p-type TFTs 63,64. The two n-type TFTs 180,182 accordingly replace TFT T5 of FIG. 11. The n-type TFTs 180,182 are only turned on when the refresh signal is high and this does not occur when the pixel is operated in the grey-scale mode.

A further feature of the pixel circuits shown in FIG. 11, 12 and 14 is that it is possible to read out the video data onto the column electrode 16 during the refresh operation. This is achieved by turning on transistor T1 12 when the refresh control signal is at a high level.

The circuits illustrated in FIGS. 11, 12 and 14 are of inverting type, that is, when refreshing the digital data the logic state of that data is inverted. It is not always desirable to perform this inversion. Various non-inverting refresh schemes will now be discussed with reference to FIGS. 15 to 17. Generally, these circuits differ from the inverting circuits described previously because they do not change the logic level represented by the voltage on the data storage capacitor, they simply correct any degradation in the voltage level that may have occurred since the data was last refreshed. This means that, in general, a temporary storage circuit is not required, though it will be appreciated that a temporary storage circuit may still be used if useful.

Figure 15:
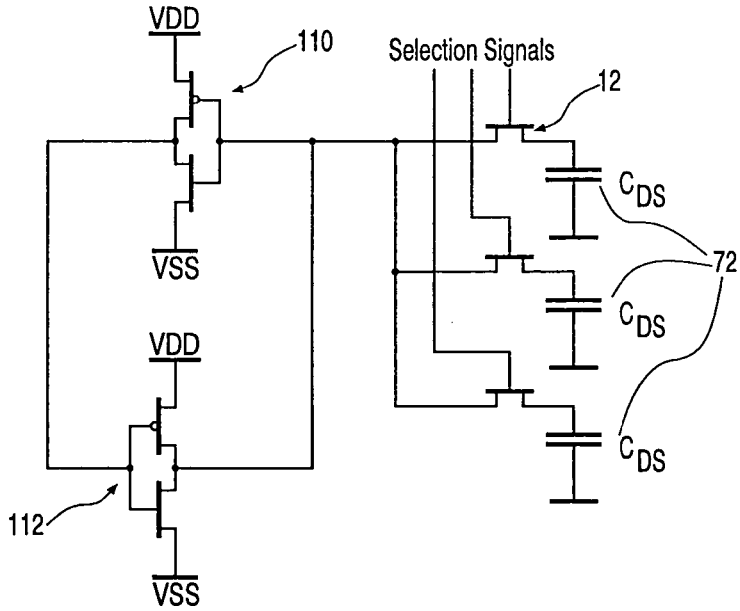
FIGS. 15, 16 and 17 illustrate suitable refresh circuits for use in the invention.

FIG. 15 illustrates a simple non-inverting refresh circuit. It simply consists of a pair of cross-coupled CMOS inverters 110, 112 connected through TFTs 12 to corresponding data storage nodes 72. The first CMOS inverter 110 has its input connected to switches 12, and an output connected to the input of the second CMOS inverter 112. The output of second CMOS inverter 112 is connected to switches 12. Thus, when one switch formed by one of the TFTs 12 is closed, the data on the corresponding storage node 72 drives the first inverter 110 and the second inverter 112 to recharge the storage node 72 to nominal levels.

Figure 16:
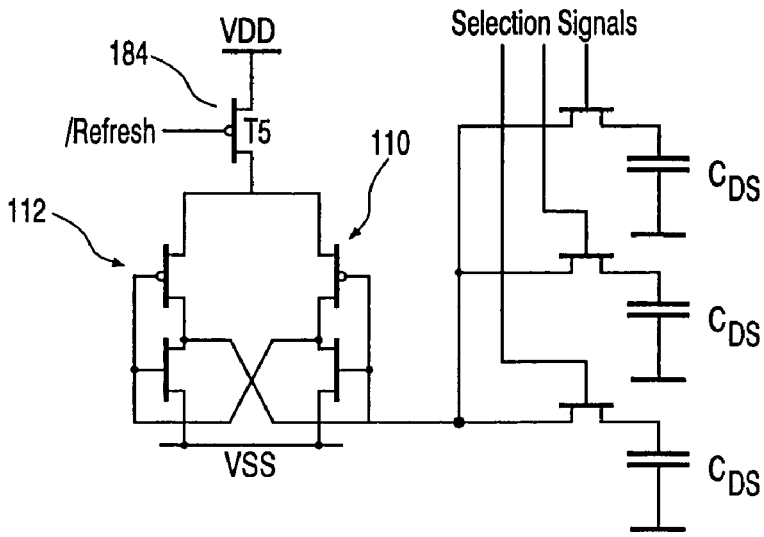

FIG. 16 illustrates an alternative implementation of first inverter 110 and second inverter 112. TFT transistor 184 is controlled by a signal/refresh taken to a low level during refresh to turn on TFT 184 and power the cross-coupled inverters 110,112. This transistor 184 allows the current flow between power supply lines (VDD and VSS) to be minimised when a refresh operation is not being carried out.

The transistor sizing and layout of the circuits of FIGS. 15 and 16 are chosen to ensure that the cross-coupled inverters 110, 112 adopt the logic state of the data storage node rather than imposing their initial state on the data storage node 72.

Figure 17:
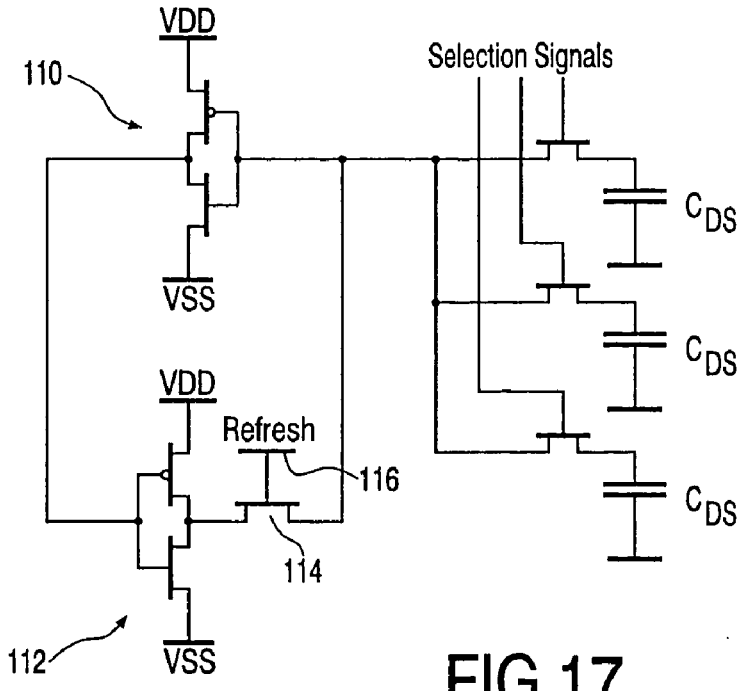

FIG. 17 illustrates an alternative non-inverting refresh circuit that eases these design constraints. The second inverter 112 is connected to switch 12 and hence storage node 72 through additional refresh TFT 114, controlled by additional refresh line 116. In use, additional refresh line 116 can be driven with a certain delay after closing one of the switches 12 which allows time for inverters 110,112 to switch and ensure the correct voltage at the output of second inverter 112 before connecting the output to drive storage node 72.

Refresh arrangements for pixel circuits having multiple bits stored separately will now be discussed. One approach is to provide a separate refresh circuit for each bit.

Figure 18:
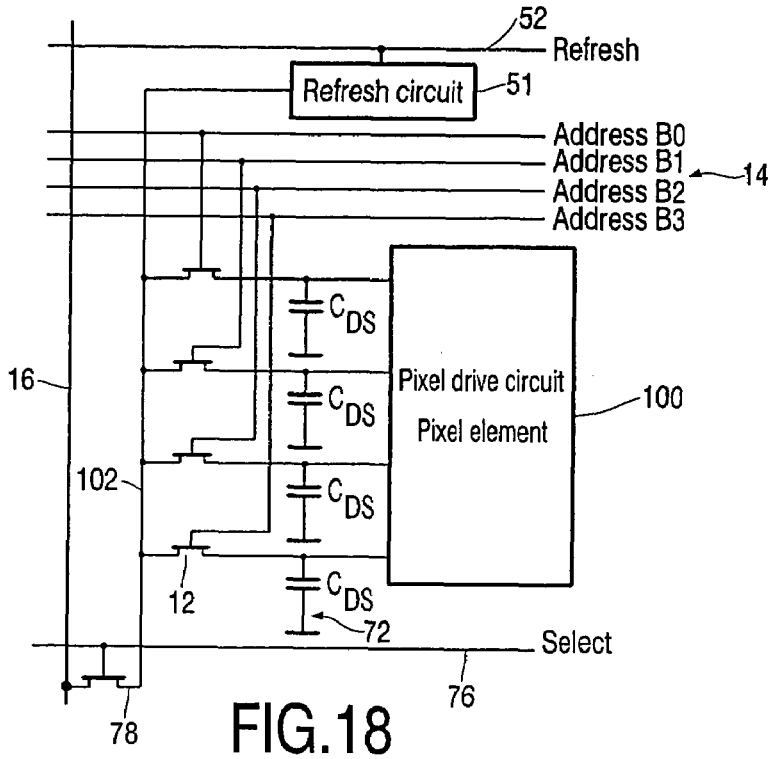
FIGS. 18, 19, 20 and 21 illustrate refresh arrangements for embodiments with a plurality of data storage nodes.

An alternative is to multiplex the refresh circuitry. FIG. 6 shows one example of this alternative. FIG. 18 shows a development of the circuit of FIG. 10 with refresh circuitry 51 driven by refresh line 52 connected to each of the TFTs 12 along the same drive line 102 driven by select TFT 78. Display circuitry 100 does not include refresh circuitry, unlike the display circuitry 74 of FIGS. 6 to 10.

The data storage capacitances 72 can be refreshed individually by holding the select line 76 in a non-selected state and selecting one of the address lines 14 to select one of the capacitances 72 through corresponding TFT 12. The refresh line 52 can then be selected to cause refresh circuit 51 to refresh the selected one of the capacitances. The other capacitances can be selected sequentially.

The digital data can be used to provide the drive signals for the pixel elements either directly or by pixel drive circuits. Pixel drive circuits can include some form of D/A converter circuits. Data can be transferred to the pixel elements or drive circuits in parallel. There are a number of ways that a plurality of stored bits may set a grey level of the pixel, including for example to implement a digital to analogue (D/A) converter within each pixel.

Figure 19:
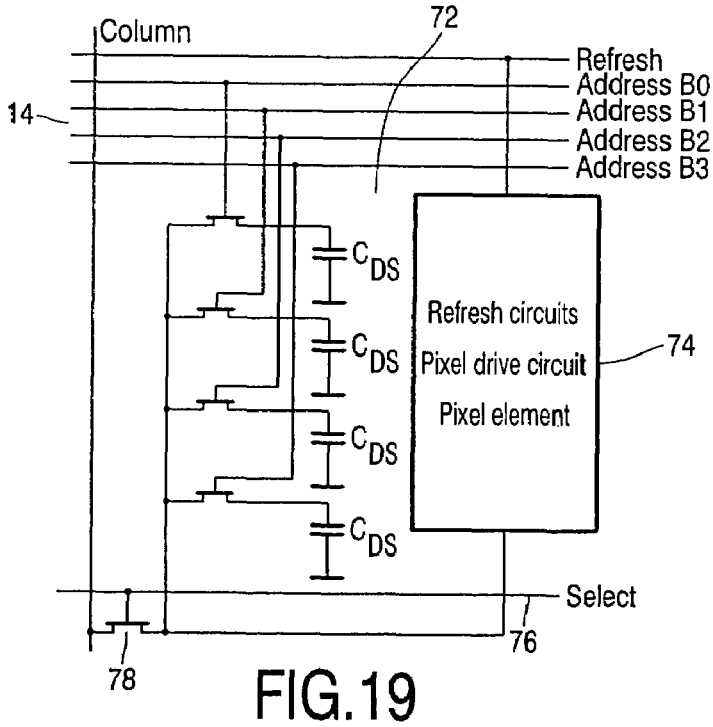

However, in some cases it may be preferable to transfer data to pixel drive circuits in serial form, for example using the circuit illustrated in FIG. 19. Display and refresh circuitry 74 is connected to each of the data storage capacitors 72 in sequence under control of address lines 14. The refresh operation may occur simultaneously with transfer of data to the pixel element or pixel drive circuit.

Figure 20:
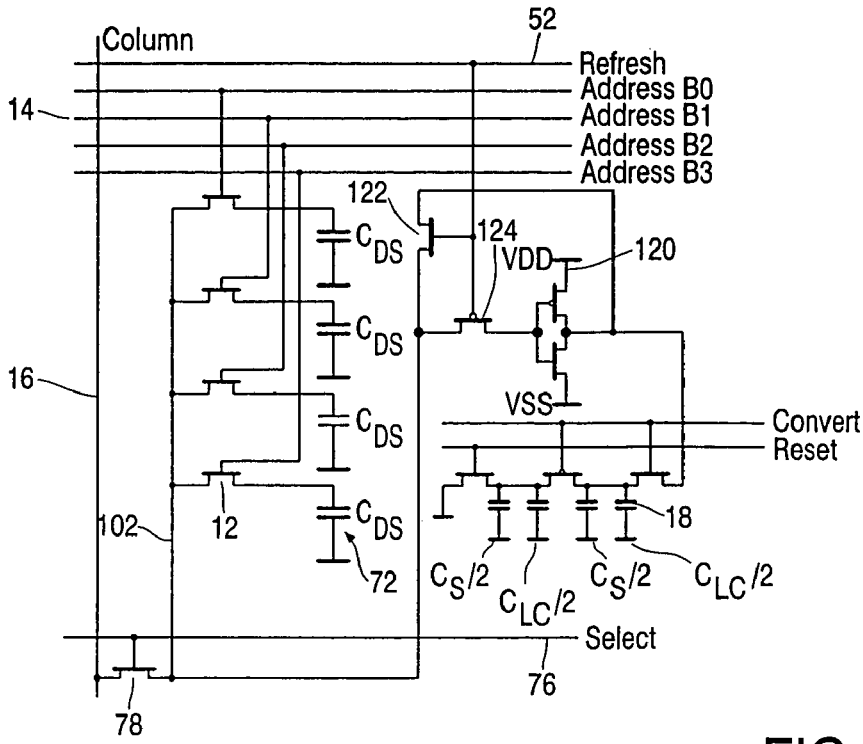

A specific example of multi-bit refresh in a pixel is shown in FIG. 20, which uses a four bit serial charge redistribution digital to analogue conversion. Drive line 102 is connected to liquid crystal capacitance 18 through first complementary TFT 124 and inverter 120, as well as second complementary TFT 122. The first complementary TFT 124 and second complementary TFT 122 are of opposite conductivity type and are each connected to refresh line 52.

In use, one of the data storage capacitors 72 is selected, and on selection of refresh line 52 the first complementary TFT 124 connects drive line 102 through inverter 120 to liquid crystal element 18. When the refresh line 52 is deselected, the second complementary TFT 122 connects the output of inverter 120 back to refresh the selected capacitor 72. The circuit acts as an inverting refresh circuit. Further details of the multiple liquid crystal elements 18 provided in U.S. Pat. No. 5,448,258 and U.S. Pat. No. 5,923,311 which are incorporated herein by reference.

Figure 21:
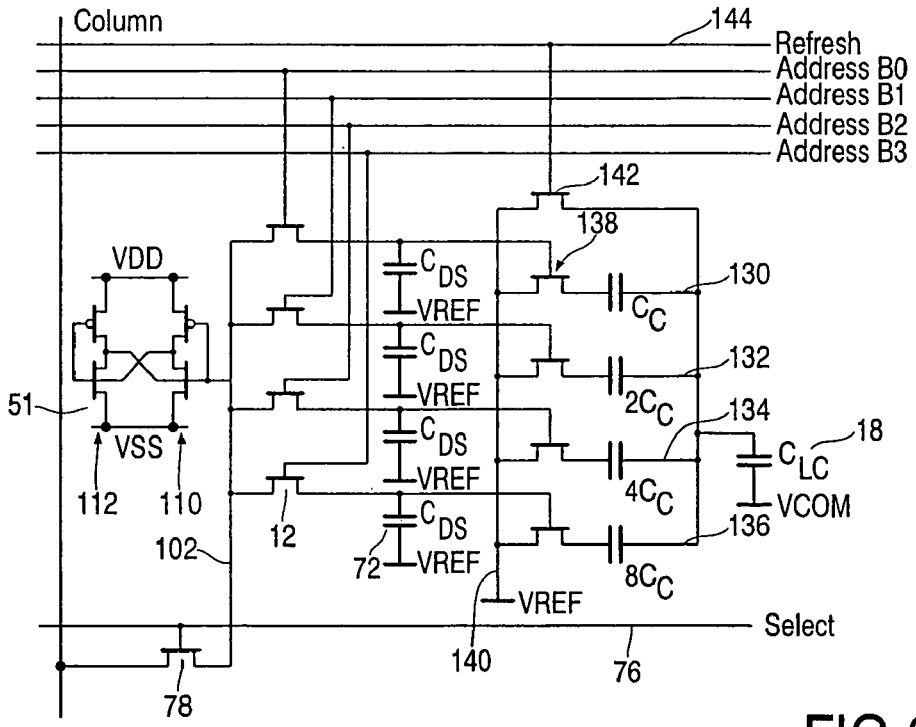

FIG. 21 illustrates a further example of a multi-bit refresh design, in this case a parallel design unlike the serial design of FIG. 20. Switching transistors 138 controlled by the voltage on respective capacitances 72 connect first 130, second 132, third 134 and fourth 136 weighted capacitors to ground line 140. The first 130, second 132, third 134 and fourth 136 weighted capacitors have capacitances in a substantially 1:2:4:8 ratio respectively, and the unit capacitance may be assigned the symbol $C_C$. The other ends of first to fourth weighted capacitors 130,132,134,136 are connected in parallel to liquid crystal element 18. A reset transistor 142 controlled by reset line 144 connects fixed voltage line 140 to liquid crystal element 18.

In use, the line 140 is connected to a reference voltage VREF, which may conveniently but not necessarily be the same as the voltage connected to storage capacitors 72. A square wave is applied to the common electrode of the display (VCOM). Just before the voltage on the common electrode is switched the voltage on the display element is reset to the same level as that on line 140 by briefly turning on TFT 142. When the common electrode voltage VCOM switches the voltage appearing across the liquid crystal element 18 is determined by the potential divider formed by the liquid crystal capacitance 18 and the parallel combination of selected weighted capacitors 130,132,134,136. The fraction of the change in common electrode voltage which appears across display element 18 therefore depends on the conduction state of the TFTs 138 and the value of the digital data stored on capacitors 72. This voltage will be maintained across the display element until the display element voltage is reset again using TFT 142 just before the common electrode voltage VCOM is switched back to its initial value. The total capacitance of the selected weighted capacitors can thus be varied between $C_C$ and $15C_C$ by selecting one or all of the weighted capacitors.

Figure 22:
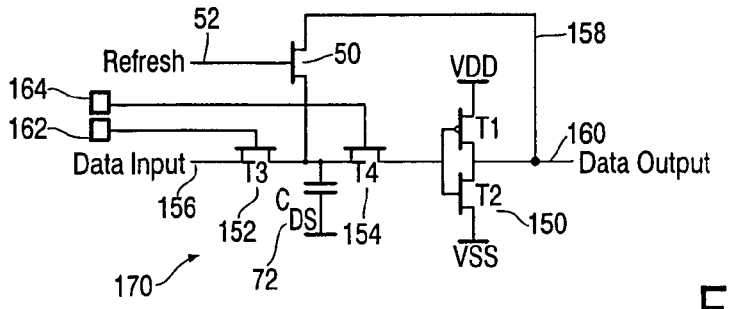
FIGS. 22 and 23 illustrate an arrangement according to the invention with a plurality of register units arranged in series.
Figure 23:
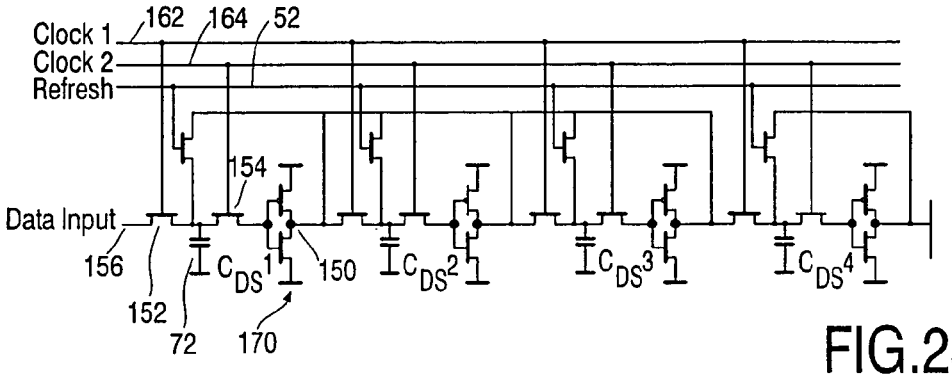

FIGS. 22 and 23 show an embodiment using an alternative approach using a shift register-like structure. FIG. 22 illustrates a single register unit and FIG. 23 four of these circuits connected together.

As illustrated in FIG. 22, register unit 170 has its data input 156 connected to first TFT 152 controlled by first clock 162 to capacitance 72, which is in turn connected through second TFT 154 and inverter 150 to output 160. Output 160 is in turn connected back to capacitance 72 through refresh data line 158 and refresh transistor 50 controlled by refresh line 52.

FIG. 23 illustrates four units 170 connected together in series with common first clock 162, second clock 164 and refresh 52 lines.

In use, the data input 156 may be connected to the column electrode. First clock 162 is selected to apply data on the data input 156 to capacitance 72 through first TFT 152. Second clock 164 can be selected to pass the signal through second TFT 154 and inverter 150 to the next unit.

If data is not being transferred sufficiently quickly through the chain of units 170 then it is necessary to refresh the data by pulsing second clock 164 periodically to transfer the signal on capacitance 72 to the input of inverter 150. The refresh signal is then taken high to pass the output signal from inverter 150 through refresh line 158 and refresh TFT 50 to invert the signal on capacitance 72.

Figure 24:
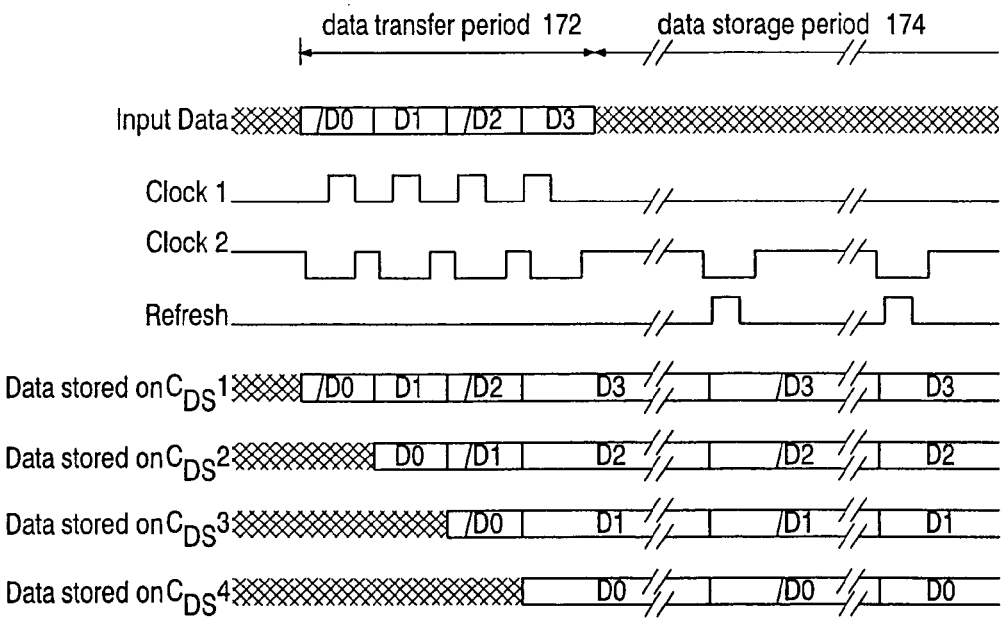
FIG. 24 illustrates the signals employed in the arrangement of FIGS. 22 and 23.

Transfer waveforms in this arrangement are illustrated in FIG. 24. In an input phase 172, data is sequentially transferred onto capacitances 72. In a storage phase 172 data remains on the capacitances and is periodically refreshed.

It is possible to simultaneously operate some pixels in the array in the static mode using data stored within the pixels and others using data supplied by an external signal source. This can be achieved without modifying the pixel circuit simply by driving the display with the appropriate signals. This approach can minimise power consumption.

For example, part of the display can show a moving image whilst the rest of the display shows a static background. The external video source only needs to supply the display with data for the region of the image showing the moving image thereby saving power.

By modifying the pixel circuits and the connections to the refresh control inputs of the pixels it would be possible to arrange for different regions of the display to operate in different modes. For example, a central region could display a moving image and an outer region a static image stored within the pixels.

Other pixel circuits could also be used to implement the refreshing of data within pixels or groups of pixels. For example the CMOS inverter could be replaced by a clocked CMOS inverter, a ratioed NMOS or PMOS inverter or a ratioless NMOS or PMOS inverter. Other methods for performing the refresh operation could also be conceived, for example, a scheme in which the data storage node is precharged and then, if appropriate, discharged. The sensing and refreshing of multiple pixel voltage levels would also be possible.

The proposed pixels with built in refresh circuits could be applied to other active matrix array devices where it is necessary to store information within the matrix. The application in display devices is clearly advantageous as the technique makes it possible to suspend the addressing of the display elements with new video information when a low power consumption is required.

As mentioned, the principle can be employed also in active matrix LED display device, such as for example, the device described in EP-A-1116205 (PHB 34351), whose contents are incorporated herein as reference material, and other kinds of active matrix devices, such as electrochromic, electrophoretic, and electroluminescent display devices.

The same kind of principle as described above in relation to display pixels could be used to advantage in other matrix array devices in which data is stored within the matrix elements.

An array of electro-mechanical actuators for example could likewise benefit from the long term data storage capability offered by refresh circuitry integrated within the array elements in the manner described above.

Similarly, active matrix transducer devices could also benefit.

The technique can also be applied to sensors comprising arrays of sensing elements in which, for example, the output of each sensor element may desirably be stored locally within the device before being read out at some later time. By introducing a local refresh circuit within the sensing elements the time between the sense operation and the readout of data from the array element would no longer be limited. Examples of such devices include optical image sensing array devices, for example as described in U.S. Pat. No. 5,349,174 and capacitance type fingerprint sensing devices as described in U.S. Pat. No. 5,325,442, whose contents are both incorporated herein as reference material.

From the present disclosure, many other modifications and variations will be apparent to persons skilled in the art. Such modifications and variations may involve features which are already known in the art and which may be used instead of or in addition to features already disclosed herein.

The invention claimed is:

1. An active matrix device, comprising an array of matrix elements wherein the matrix elements each have at least one storage node having a capacitance for storing data dynamically in the form of charge stored on the capacitance, and the matrix elements further include refresh circuitry for refreshing the data stored on the storage node, wherein the refresh circuitry includes an inverter that is configured to selectively invert the data corresponding to the charges stored on the storage node.

2. The active matrix device of claim 1, wherein the refresh circuitry includes a temporary storage circuit for storing the data on the at least one storage node and a storage node drive circuit for driving the storage node based on the data stored on the temporary storage circuit.

3. The active matrix device of claim 2, wherein each matrix element includes:

an address switch controlled by an address line and connected between a column line and the at least one data storage node, a storage switch connecting the storage node to the temporary storage circuit, and a refresh switch connecting the storage node to the storage node drive circuit, the storage switch and the refresh switch having control terminals connected to a common refresh line for switching between:

a first setting in which the storage switch is open and the refresh switch is closed, and a second setting in which the storage switch is closed and the refresh switch is open.

4. The active matrix device of claim 3, wherein the matrix elements each include a plurality of data storage capacitances for storing a plurality of bits of data per matrix element.

5. The active matrix device of claim 4, including a plurality of row address lines controlling a plurality of address thin film transistors connected to respective data storage capacitances to select one or more of the data storage capacitances.

6. The active matrix device of claim 5, wherein:

the plurality of address thin film transistors are connected to a common drive line connected through a select transistor to the column line, and the select transistor is controlled by a select line.

7. The active matrix of claim 2, wherein the temporary storage circuit and the storage node drive circuit are configured to be controlled by a single refresh signal.

8. The active matrix device of claim 1, including a refresh line for activating the refresh circuitry to refresh the storage node.

9. The active matrix device of claim 1, wherein the storage node includes a capacitor.

10. The active matrix device of claim 1, wherein the matrix elements each include a plurality of data storage capacitances for storing a plurality of bits of data per matrix element.

11. The active matrix device of claim 10, including a plurality of row address lines controlling a plurality of address thin film transistors connected to respective data storage capacitances to select one or more of the data storage capacitances.

12. The active matrix device of claim 11, wherein the plurality of address thin film transistors are connected to a common drive line connected through a select transistor to the column line, wherein the select transistor is controlled by a select line.

13. The active matrix device of claim 12, including a refresh line controlling the refresh circuit to connect the refresh circuitry to the common drive line to refresh the selected data storage capacitor.

14. The active matrix device of claim 10, wherein:

each matrix element includes a plurality of register units connected in series, each register unit including a data storage node, and register units connected to subsequent register units including a driver that is configured to drive the next register unit; and at least one clock line is provided for controlling the transmission of data along the series of register units.

15. The active matrix device of claim 14, wherein in each register unit, an output of the driver is connected back to the storage node for refreshing data stored on the storage node so that the driver constitutes the refresh circuit.

16. The active matrix device of claim 1, wherein the refresh circuitry includes a pair of cross-coupled inverters.

17. The active matrix device of claim 1, wherein the matrix elements are display pixels for displaying an image pixel in accordance with data stored on the data storage node.

18. The active matrix device of claim 1, wherein the matrix elements are pixel electrodes for controlling liquid crystal.

19. A method of operating an active matrix device having matrix elements including capacitative storage nodes, comprising:

storing image data as charge on the storage nodes, and operating the active matrix device in a refresh mode including displaying the stored image data, and periodically applying refresh signals to refresh circuitry within the matrix elements to cause the refresh circuitry to invert the image data corresponding to the charges stored on the storage nodes.

20. The method of claim 19, further including operating the active matrix device in a normal mode including:

regularly addressing the matrix elements with fresh video information, and displaying the video information.

* * * * *